US011378237B2

(12) United States Patent
Liu

(10) Patent No.: US 11,378,237 B2
(45) Date of Patent: Jul. 5, 2022

(54) ILLUMINATED CHRISTMAS TREE DECORATIVE LIGHT CONTROL CIRCUIT

(71) Applicant: Ling Yung Lin, Taipei (TW)

(72) Inventor: Yan Liu, Taipei (TW)

(73) Assignee: Ling Yung Lin, Taipei (TW)

( * ) Notice: Subject to any disclaimer, the term of this patent is extended or adjusted under 35 U.S.C. 154(b) by 0 days.

(21) Appl. No.: 17/094,995

(22) Filed: Nov. 11, 2020

(65) Prior Publication Data

US 2021/0140594 A1 May 13, 2021

(30) Foreign Application Priority Data

Nov. 12, 2019 (CN) ..... 201921947601.8

(51) Int. Cl.

| | |
|---|---|
| ***F21S 4/10*** | (2016.01) |
| ***H05B 45/30*** | (2020.01) |
| ***A47G 33/08*** | (2006.01) |
| *F21V 23/00* | (2015.01) |
| *F21W 121/04* | (2006.01) |
| *H05B 47/155* | (2020.01) |
| *H05B 47/19* | (2020.01) |

(52) U.S. Cl.

CPC ..... *F21S 4/10* (2016.01); *A47G 33/08* (2013.01); *H05B 45/30* (2020.01); *A47G 2033/0827* (2013.01); *F21V 23/003* (2013.01); *F21W 2121/04* (2013.01); *H05B 47/155* (2020.01); *H05B 47/19* (2020.01)

(58) Field of Classification Search

CPC .... F21S 4/00; F21S 4/10; A47G 33/08; A47G 33/04; A47G 2033/0827; H05B 45/30; H05B 47/10; H05B 47/155; H05B 47/16; H05B 47/175; H05B 47/19

See application file for complete search history.

(56) References Cited

U.S. PATENT DOCUMENTS

| | | | | |
|---|---|---|---|---|
| 6,653,797 | B2 * | 11/2003 | Puleo, Sr | H05B 47/155 315/185 S |
| 9,113,515 | B2 * | 8/2015 | Long | H01R 13/6456 |
| 10,683,974 | B1 * | 6/2020 | Chen | F21V 23/06 |
| 2004/0075401 | A1 * | 4/2004 | Segan | H05B 47/155 315/291 |

* cited by examiner

*Primary Examiner* — Thai Pham
(74) *Attorney, Agent, or Firm* — Rabin & Berdo, P.C.

(57) ABSTRACT

An illuminated Christmas tree decorative light control circuit includes: a main controller and at least one branch controller. The main controller includes a main control circuit, a timing circuit, a memory circuit, a RF remote control circuit and a control output circuit capable of outputting main control signals. Each branch controller includes a signal transmission circuit capable of receiving the main control signal, a connecting terminal respectively connected to a plurality of decorative light modules (LED light string/strip equipped with a plurality of LEDs arranged linearly) installed on the Christmas tree branches, and a driving circuit arranged between the signal transmission circuit and the connecting terminal. Accordingly, the decorative light module on each tree branch can be installed independently and further connected to the corresponding branch controller, followed by connecting all of the branch controllers to a main controller. Consequently, the overall wiring is more convenient and facilitated.

11 Claims, 4 Drawing Sheets

ILLUMINATED CHRISTMAS TREE DECORATIVE LIGHT CONTROL CIRCUIT

BACKGROUND OF THE INVENTION

1. Technical Field

The present invention relates to the technical field of a control circuit, and in particular, to an illuminated Christmas tree decorative light control circuit.

2. Description of Related Art

Pine or evergreen trees are often brought home to be used as part of the Christmas celebration, and it is a tradition to use ornaments, decorative lights, flower rings and ribbons etc. for the decoration of Christmas trees. In addition, to satisfy the environmental protection and energy saving demands of the modern society, decorative lights using LEDs as the light source are becoming more popular and are widely used for the decoration of Christmas trees.

Common LED decorative lights mostly combine a plurality of LED illuminating elements onto an elongated circuit in order to form a light string (light strip) having a fixed length specification (3M, 4M, 7M). In addition, to allow the light string (light strip) to have different lighting modes, typically, it is necessary to use a controller with built-in control program to control the light string (light strip), thereby allowing it to form a light strip module having various illumination changing effects (such as: flash frequency, alternating or illumination in turns etc.).

However, since most Christmas trees typically have a lot of main branches on the trunk, and each main branch can also have further termination branches extended therefrom. If one single light strip module is used to decorate a Christmas tree, since it is necessary to wrap the light strip module between the trunk and the main branches repetitively, the termination branches often cannot be decorated completely due to insufficient length of the light strip module. A feasible solution is to connect the rear end of the original light strip module to another light string (light strip) in order to extend the overall length of the light strip module to a sufficient length. Nonetheless, the length of the light strip module becomes extremely long, causing the construction work to be difficult and the overall circuit becomes messy, and the repair work during malfunction also becomes difficult.

Furthermore, if a plurality of light strip modules are jointly decorated onto one single Christmas tree, then despite that a light strip module can be installed on each relatively large main branch and the aforementioned drawback can be improved, the wiring distribution of the overall decorative light becomes relatively simple and standard. However, in terms of the actual use, since each light strip module has an independent controller, the situation where the lighting mode of each light strip module may not be controlled uniformly may occur. Moreover, the plurality of light strip modules installed can also cause the overall construction cost to increase, such that it is not economically cost effective.

BRIEF SUMMARY OF THE INVENTION

A primary objective of the present invention is to provide an illuminated Christmas tree decorative light control circuit, which utilizes a single main controller installed at the bottom portion of the tree trunk for connecting to and controlling a plurality of branch controllers installed on each main tree branch; in addition, each branch controller is further connected to and controlling the decorative light modules (light string/light strip equipped with a plurality of LED arranged linearly) on each tree branch, such that it is optimal and suitable to the decorative light control of a Christmas tree having complicated tree branches. During the construction, each decorative light module can be installed on each tree branch independently first, followed by connecting the plurality of decorative light modules to the corresponding branch controllers respectively. Next, all of the branch controllers are connected to the main controller in order to allow the main controller to uniformly control each decorative light module via each branch controller, thereby achieving the objectives of simplified construction procedure and neatly arranged circuits.

To achieve the aforementioned objectives and technical effects, the control circuit of the present invention comprises a main controller 1 and at least one branch controller 2 electrically connected to the main controller 1. The main technical features adopted rely in: the main controller 1 comprising a main control circuit 11 and a control output circuit 16, the main control circuit 11 having a main control chip U1 arranged therein, the main control chip U1 configured to generate and output a control signal for a plurality of lighting modes via a built-in dimming control program, the control output circuit 16 configured to receive the control signal outputted by the main control circuit 11 and convert it to output a main control signal; each one of the branch controllers 2 comprising a signal transmission circuit 21, a driving circuit 22 and a connecting terminal PIN, the signal transmission circuit 21 configured to receive the main control signal outputted by the control output circuit 16, and connected to the connecting terminal PIN via the driving circuit 22 and divided into a plurality of terminal sets, thereby using each terminal set for connecting to a decorative light module 3 (light string/light strip equipped with a plurality of LEDs arranged linearly) installed on each branch of a Christmas tree, such that each decorative light module 3 is able to receive an operation control of the main controller 1 via each one of the branch controllers 2.

According to the aforementioned structure, wherein the main controller 1 further comprises: a timing circuit 13, a memory circuit 14 and a RF remote control circuit 15 connected to the main control circuit 11 respectively, the RF remote control circuit 15 configured to receive a RF wireless control signal from external in order to form an operational command inputted into the main control circuit, the timing circuit 13 configured to be operable for adjusting a running time of the main control circuit 11, the memory circuit 14 configured to store a control parameter of the built-in dimming control program of the main control chip U1.

According to the aforementioned structure, wherein the main controller 1 further comprises: an anti-reverse power source connection circuit 12 connected to the main control circuit 11; the anti-reverse power source connection circuit 12 comprising one three-terminal voltage regulator Q7 and a diode D5; the diode D5 arranged between an input end of the three-terminal voltage regulator Q7 and a main power source input end VDCin in a forward direction, such that when a polarity of an external power source connected to the main power source input end VDCin is correct, the diode D5 is conducted in order to allow the three-terminal voltage regulator Q7 to operate normally; on the contrary, when the polarity is incorrect, the diode D5 is not conducted to prevent the power source from connecting to the three-terminal voltage regulator Q7.

According to the aforementioned structure, wherein the control output circuit 16 comprises a control chip U4, a resistor R4 and an indicator lamp circuit 161; the control chip U4 is an erasable programable read only memory (EPROM) with 16 pins, a fifth pin of the control chip U4 is connected to the output end of the three-terminal voltage regulator Q7 in order to provide a power source necessary for conduction; a sixth pin, a seventh pin, an eighth pin and a ninth pin of the control chip U4 connected to a first pin, a fourteenth pin, a thirteenth pin and a twelfth pin of the main control chip U1 respectively in order to receive the control signal outputted by the main control chip U1; a tenth pin of the control chip U4 is connected to an eighth pin of the main control chip U1 via the resistor R4, a twelfth pin of the control chip U4 is connected to a ground end GND; a thirteenth pin, a fourteenth pin, a fifteenth pin and a sixteenth pin of the control chip U4 are jointly connected to a main control signal output end Scon in order to output the main control signal for controlling the branch controller 2; the indicator lamp circuit 161 comprises four indicator lamps D1, D2, D3, D4, wherein two of the indicator lamps D1, D2 are connected to each other in a forward-reverse parallel manner, and one end thereof is connected to a first pin of the control chip U4, the other two indicator lamps D3, D4 are connected to each other in a forward-reverse parallel manner, and one end thereof is connected to a second pin of the control chip U4, another end of the four indicator lamps D1, D2, D3, D4 is connected to a third pin of the control chip U4 jointly via a resistor R2, such that the timing circuit 13 is able to set various timing periods for the indicator lamps D1, D2, D3, D4 via the first pin, the second pin and third pin of the control chip U4 and the resistor R2.

According to the aforementioned structure, wherein the main power source input end VDCin is connected to an external AC power source via a power source module 10, such that the AC power source is converted to a DC power source of DC5V-36V via the power source module 10, and further connected to the main power source input end VDCin.

According to the aforementioned structure, wherein the main control chip U1 is an erasable programable read only memory (EPROM) with 14 pins; a tenth pin of the main control chip U1 is connected to an output end of the three-terminal voltage regulator Q7 via a resistor R3, and the tenth pin of the main control chip U1 is further connected to the ground end GND via a switch K1.

According to the aforementioned structure, wherein the timing circuit 13 includes two capacitors C1, C2 and a crystal oscillator JZ1, two ends of the crystal oscillator JZ1 are connected to a fifth pin and a sixth pin of the main control chip U1 respectively, and the two ends of the crystal oscillator are further connected to the ground end GND via the two capacitors C1, C2.

According to the aforementioned structure, wherein the memory circuit 14 comprises a storage chip U2 with 8 pins and a resistor R1, an eighth pin of the storage chip U2 is connected to the output end of the three-terminal voltage regulator Q7, and the eighth pin of the storage chip U2 is further connected to a third pin of the main control chip U1 and a fifth pin of the storage chip U2 respectively via the resistor R1, a sixth pin of the storage chip U2 is connected to a second pin of the main control chip U1, and a fourth pin of the storage chip U2 is connected to the ground end GND.

According to the aforementioned structure, wherein the RF remote control circuit 15 comprises a radio frequency integrated circuit chip U3 with 8 pins, two chip inductors L1, L2, five capacitors C4, C5, C6, C7, C8, a crystal oscillator JZ2 and an antenna AT; a first pin and a sixth pin of the radio frequency integrated circuit chip U3 are jointly connected to the ground end GND; a second pin and a third pin of the radio frequency integrated circuit chip U3 are jointly connected to the output end of the three-terminal voltage regulator Q7 and also jointly connected to one end of the two capacitors C4, C6 and to one end of the chip inductor L1, another end of the capacitor C4 is respectively connected to one end of the capacitor C5, one end of the chip inductor L2 and the antenna AT, another end of the capacitor C6, another end of the chip inductor L1, another end of the chip inductor L2 and another end of the capacitor C5 are jointly connected to the ground end GND respectively, a fourth pin of the radio frequency integrated circuit chip U3 is grounded via the capacitor C7, a fifth pin of the radio frequency integrated chip U3 is connected to a seventh pin of the main control chip U1, a seventh pin of the radio frequency integrated circuit chip U3 is grounded via the capacitor C8, an eighth pin of the radio frequency integrated circuit chip U3 is connected to the ground end GND via the crystal oscillator JZ2.

According to the aforementioned structure, wherein the signal transmission circuit 21 comprises: a plurality signal transmission chips U5, U6, U7, U8 connected in series, a plurality of resistors R5, R6, R7, R8, R9, R10, R11, R12, R13, R14, R15, R16, R17, R18, R19, R20, R21, R22, a plurality of capacitors C10, C11, C12, C13; each one of the signal transmission chips U5, U6, U7, U8 is a single-wire transmission three-channel LED driver control chip with 8 pins; a first pin, a second pin and a third pin of the signal transmission chip U8 are respectively connected to a branch power source input end V+ in sequence via the resistors R18, R19, R20; a fourth pin of the signal transmission chip U8 is directly connected to the ground end GND, a fifth pin of the signal transmission chip U8 is connected to a sixth pin of the signal transmission chip U7 via the resistor R16; the sixth pin of the signal transmission chip U8 is connected to a branch control signal input end Sin via the resistor R21; the branch control signal input end Sin is configured to receive the main control signal outputted by the main controller 1; an eighth pin of the signal transmission chip U8 is connected to the branch power source input end V+ via the resistor R22; the branch power source input end V+ is configured to receive a power source provided by the main controller 1, and the capacitor C13 is arranged between the first pin and the eighth pin of the signal transmission chip U8; a first pin, a second pin and a third pin of the signal transmission chip U7 are respectively connected to the branch power source input end V+ in sequence via the resistors R13, R14, R15; a fourth pin of the signal transmission chip U7 is directly connected to the ground end GND; a fifth pin of the signal transmission chip U7 is connected to a sixth pin of the signal transmission chip U6 via the resistor R12; an eighth pin of the signal transmission chip U7 is connected to the branch power source input end V+ via the resistor R17 in order to conduct to a power source required, and the capacitor C12 is arranged between the first pin and the eighth pin of the signal transmission chip U7; a first pin, a second pin and a third pin of the signal transmission chip U6 are respectively connected to the branch power source input end V+ in sequence via the resistors R9, R10, R11 in order to conduct to a power source required; a fourth pin of the signal transmission chip U6 is directly connected to the ground end GND; a fifth pin of the signal transmission chip U6 is connected to a sixth pin of the signal transmission chip U5 via the resistor R8, and the capacitor C11 is arranged between the first pin and the eighth pin of the signal transmission chip U6; a first pin, a second pin and a third pin of the signal transmission chip U5 are respectively connected to the branch power source input end V+ in sequence via the resistors R5, R6, R7 in order to conduct to a power source required; a fourth pin of the signal transmission chip U5 is directly connected to the ground end GND; the fifth pin of the signal transmission chip U5 is connected to a branch control signal output end Sout; the branch control signal output end Sout is configured to be connected to another branch controller 2 and to provide a control signal required; the capacitor C10 is arranged between the first pin and the eighth pin of the signal transmission chip U5.

According to the aforementioned structure, wherein the driving circuit 22 comprises: a plurality driving chips U9, U10, U11, U12, U13, a plurality of resistors R23, R24, R25, R26, R27; each one of the driving chips U9, U10, U11, U12, U13 is a two-way driving control chip with 8 pins; first pins of the driving chips U9, U10, U11, U12, U13 are respectively connected to a branch power source input end V+ in order to conduct to a power source required; third pins and seventh pins of the driving chips U9, U10, U11, U12, U13 are respectively connected to a ground end GND; a second pin and a fourth pin of the driving chip U13 are connected to a first pin and a second pin of the connecting terminal PIN via the resistor R27 in order to form a first terminal set provided for connecting to each one of the decorative light modules 3; a fifth pin and an eighth pin of the driving chip U13 are respectively connected to a first pin and a second pin of the signal transmission chip U8, thereby receiving signals from the signal transmission chip U8 to drive the decorative light module 3 connected to the first terminal set of the connecting terminal PIN; a second pin and a fourth pin of the driving chip U12 are connected to a third pin and a fourth pin of the connecting terminal PIN via the resistor R26 in order to form a second terminal set provided for connecting to each one of the decorative light modules 3; a fifth pin of the driving chip U12 is connected to a third pin of the signal transmission chip U8, an eighth pin of the driving chip U12 is connected to a first pin of the signal transmission chip U7, thereby receiving signals from the signal transmission chips U7, U8 respectively in order to drive the decorative light module 3 connected to the second terminal set of the connecting terminal PIN; a second pin and a fourth pin of the driving chip U11 are connected to a fifth pin and a sixth pin of the connecting terminal PIN via the resistor R25 in order to form a third terminal set provided for connecting to each one of the decorative light modules 3; a fifth pin and an eighth pin of the driving chip U11 are respectively connected to a second pin and a third pin of the signal transmission chip U7, thereby receiving signals from the signal transmission chip U7 in order to drive the decorative light module 3 connected to the third terminal set of the connecting terminal PIN; a second pin and a fourth pin of the driving chip U10 are connected to a seventh pin and an eighth pin of the connecting terminal PIN via the resistor R24 in order to form a fourth terminal set provided for connecting to each one of the decorative light modules 3; a fifth pin and an eighth pin of the driving chip U10 are respectively connected to a second pin and a third pin of the signal transmission chip U6, thereby receiving signals from the signal transmission chip U6 in order to drive the decorative light module 3 connected to the fourth terminal set connected to the connecting terminal PIN; a second pin and a fourth pin of the driving chip U9 are connected to a ninth pin and a tenth pin of the connecting terminal PIN via the resistor R23 in order to form a fifth terminal set provided for connecting to each one of the decorative light modules 3; a fifth pin and an eighth pin of the driving chip U9 are respectively connected to a first pin and a second pin of the signal transmission chip U5, thereby receiving signals from the signal transmission chip U5 in order to drive the decorative light module 3 connected to the fifth terminal set of the connecting terminal PIN.

In comparison of the currently existing techniques, the advantages of the present invention include:

1. One single main controller is used to connect to and to control a plurality of branch controllers, and each branch controller is further connected to and controlling a plurality of decorative light modules respectively, thereby creating a completely modularized and integrated structure. Therefore, the overall wiring structure and construction procedure can be simplified. In addition, since each decorative light module has its independent wiring, in case of any malfunction, the connection portion of the decorative light module and its branch controller can be identified easily and swiftly in order to perform repair or replacement of the damaged decorative light module without any changes or adjustments to other decorative light modules. As a result, the repair procedure is simplified and the cost of use is reduced.

2. For the main controller, the quantity of the branch controllers can be additionally increased depending upon the needs directly. In addition, with the increase of the quantity of the branch controllers, the quantity of the decorative light module connected thereto can be increased. Furthermore, since all of the decorative light modules are jointly connected to and controlled by the main controller, during the use, the overall scale of the decorative light can be expanded depending upon the customized needs; as a result, it can have a relatively broader applicable scope.

3. The main controller includes an anti-reverse power source connection circuit capable of preventing reverse connection of power source, a memory circuit capable of storing control parameters operated and a RF remote circuit capable of remotely operating the main controller from the external, such that the convenience and safety of use are increased.

To further explain the aforementioned objectives, technical effects and characteristics of the present invention, please refer to the illustrations of the following accompanied drawings:

DETAILED DESCRIPTION OF THE INVENTION

Figure 1:
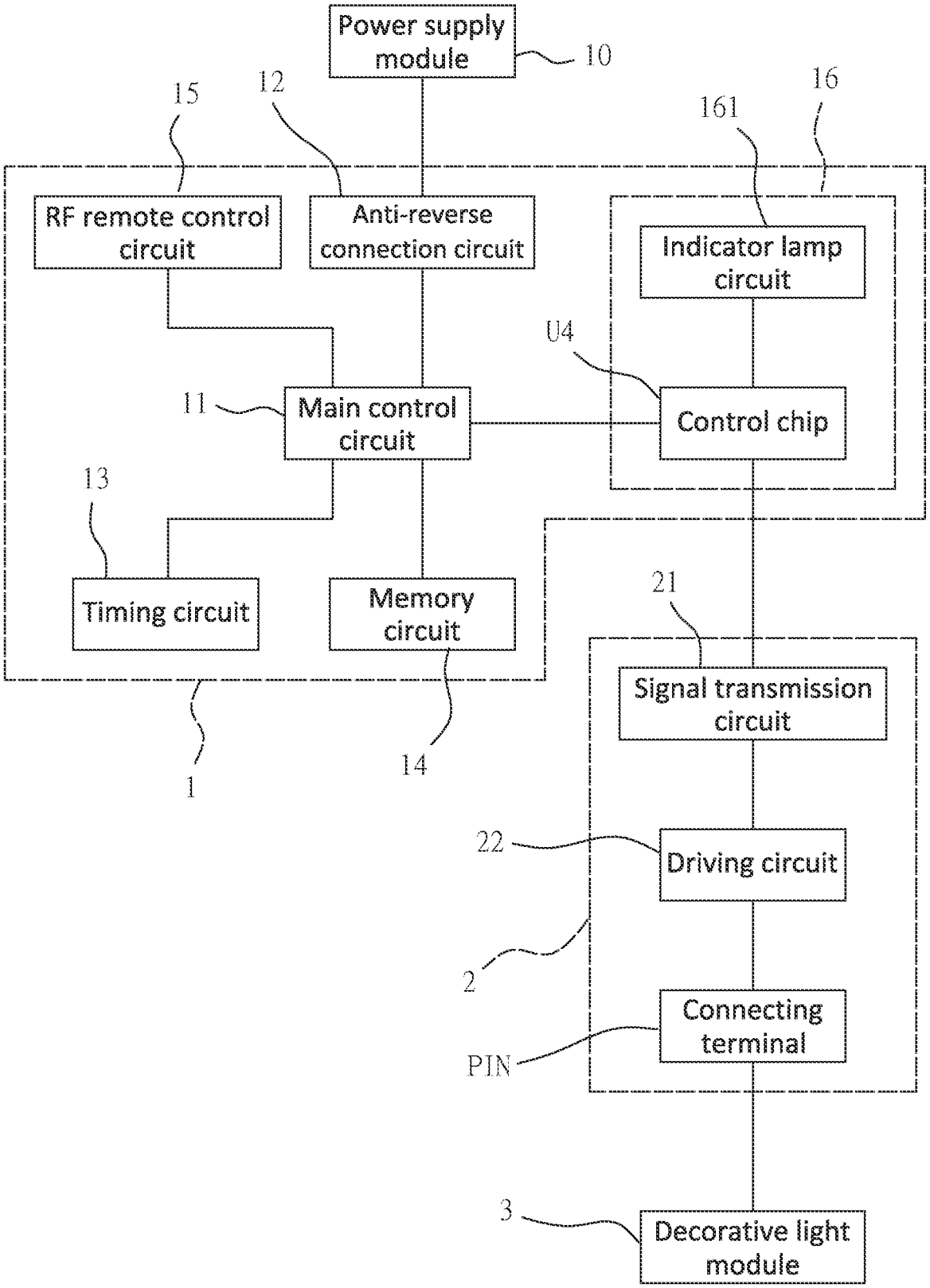
FIG. 1 is a block diagram of the main circuit structure of the present invention.
Figure 2:
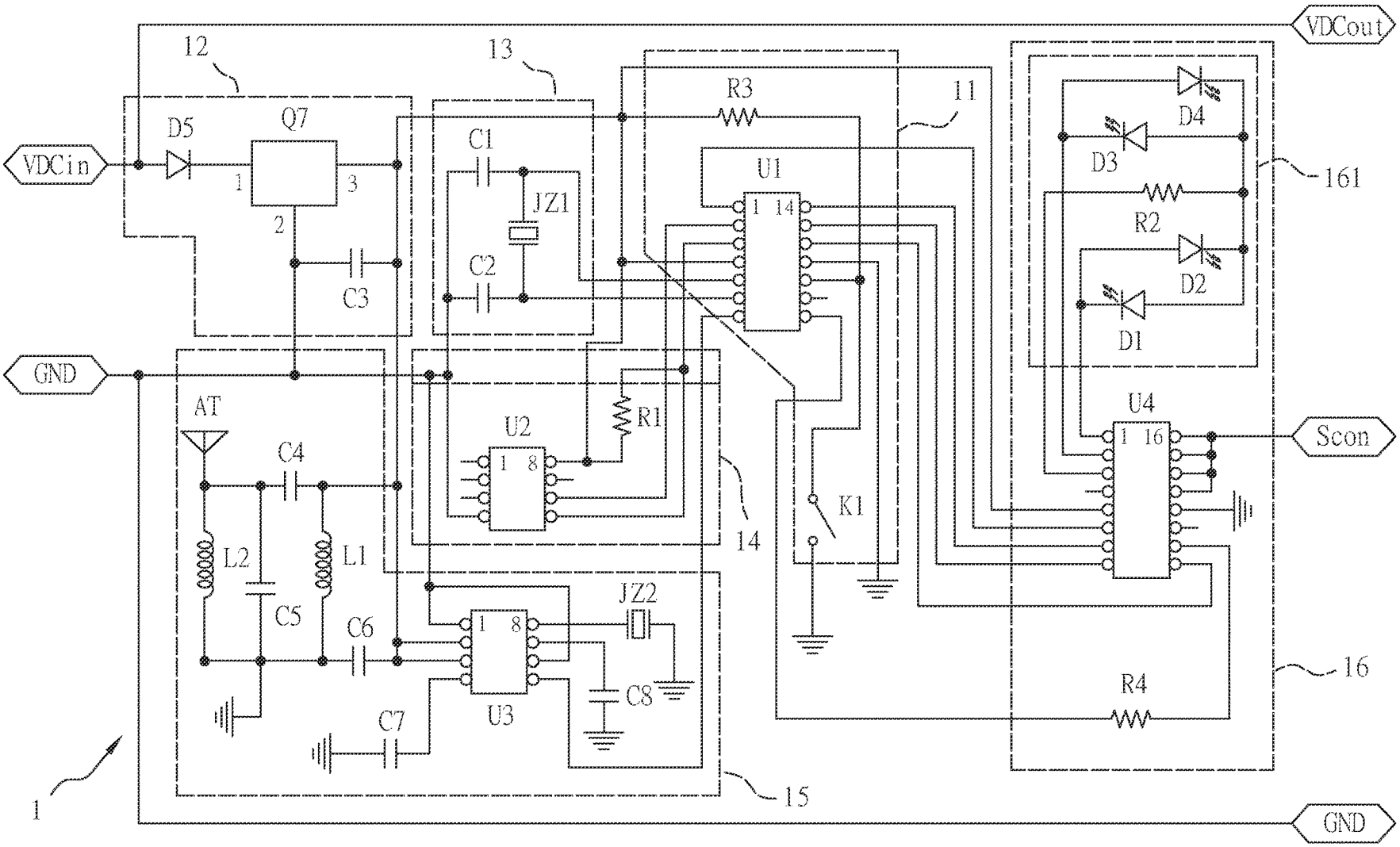
FIG. 2 is a circuit diagram of the main controller of the present invention.
Figure 3:
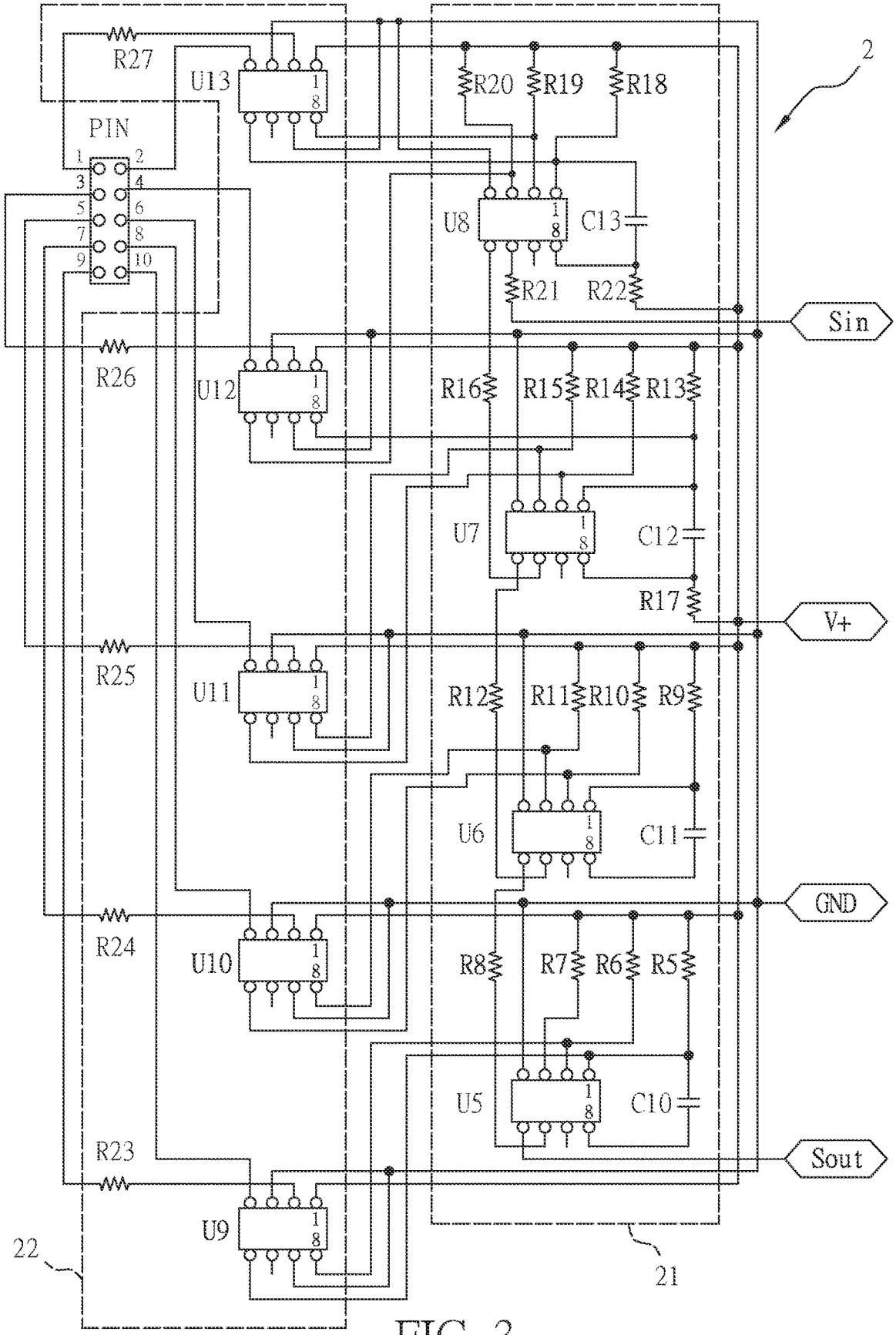
FIG. 3 is a circuit diagram of the branch controller of the present invention.

Please refer to FIG. 1 to FIG. 3. From the drawings, it can be understood that the structure of the present invention mainly comprises: a controller 1, at least one branch controller 2 and a plurality decorative light modules 3 (light string/light strip equipped with a plurality of LEDs arranged linearly); wherein the main controller 1 is mainly formed by a main control circuit 11, an anti-reverse power source connection circuit 12, a timing circuit 13, a memory circuit, a RF remote control 15 and a control output circuit 16.

The anti-reverse power source connection circuit 12 includes a three-terminal voltage regulator Q7, a capacitor C3 and a diode D5; wherein the capacitor C3*s* arranged between the output end (third pin) of the three-terminal voltage regulator Q7 and the ground end GND (second pin), the diode D5 is arranged between the input end (first pin) of the three-terminal voltage regulator Q7 and a main power source input end VDCin in a forward direction. When the polarity of the external power source connected to the main power source input end VDCin is correct, the diode D5 is conducted in order to allow the three-terminal voltage regulator Q7 to operate normally. On the contrary, if the polarity is incorrect, the diode D5 is not conducted to prevent the power source from connecting to the three-terminal voltage regulator Q7, such that the protection effect capable of preventing the main control chip U1 from being punctured can be achieved.

During the actual application, if a conventional grid AC power source (AC 100-240V) is used, then the AC power source can pass through a power source module 10 (power adapter) for rectification and filter in order to convert it into a DC power source (DC 5V-36V), followed which the main power source input end VDCin is connected to the main controller 1 for conduction. The main power source input end VDCin can be directly connected to a main power source output end VDCout, and two ground ends GND connected to each other can be arranged at one side of the corresponding main power source input end VDCin and the main power source output end VDCout respectively. The main power source output end VDCout and the ground end GND can be used to form a branch power supply end capable of providing the power source necessary for the branch controller 2.

The main control circuit 11 includes a main control chip U1, a resistor R3 and a switch K1; wherein the main control chip U1 is an erasable programable read only memory (EPROM) with 14 pins and equipped with a built-in dimming function in order to control and generate various different lighting modes via a built-in control program (the use of a control program in the main control chip U1 is an a known technique commonly used). The fourth pin of the main control chip U1 is connected to the output end (third pin) of the three-terminal voltage regulator Q7 in order to conduct a working voltage of DC 36V. The resistor R3 is arranged between the fourth pin and the tenth pin of the main control chip U1, and the tenth pin of the main control chip U1 is grounded via the switch K1.

The timing circuit 13 includes: two capacitors C1, C2 and a crystal oscillator JZ1; wherein two ends of the crystal oscillator are connected to the fifth pin and the sixth pin of the main control chip U1 respectively, and the two ends of the crystal oscillator JZ1 are further grounded via the capacitors C1, C2 respectively, thereby forming a timing mechanism connected to the main control chip U1.

The memory circuit 14 comprises a storage chip U2 with 8 pins and a resistor R1; wherein the eighth pin of the storage chip U2 is connected to the output end (third pin) of the three-terminal voltage regulator Q7 in order to connect to the required power source. In addition, the eighth pin of the storage chip U2 is jointly connected to the third pin of the main control chip U1 and the fifth pin of the storage pin U2 via the resistor R1, the sixth pin of the storage chip U2 is connected to the second pin of the main control chip U1, and the fourth pin of the storage chip U2 is grounded. Accordingly, the storage chip U2 is able to store various operational setting parameters of the main control chip U1, and during the restoration of power supply after power shutdown, it is able to recover various functions already set before the power shutdown.

The RF remote control circuit 15 comprises a radio frequency integrated circuit chip U3 with 8 pins, two chip inductors L1, L2, capacitors C4, C5, C6, C7, C8, a crystal oscillator JZ2 and an antenna AT; wherein the first pin and the sixth pin of the radio frequency integrated circuit chip U3 are grounded jointly, the second pin and third pin of the radio frequency integrated circuit chip U3 are jointly connected to the output end (third pin) of the three-terminal voltage regulator Q7 and are also jointly connected to one end of the capacitors C4, C6 and the chip inductor L1; another end of the capacitor C4 is connected to one end of the capacitor C5, one end of the chip inductor L2 and the antenna AT respectively; another end of the capacitor C6 is respectively connected to another end of the chip inductor L1, another end of the chip inductor L2, another end of the capacitor C5 and jointly connected to the ground; the fourth pin of the radio frequency integrated circuit chip U3 is grounded via the capacitor C7; the fifth pin of the radio frequency integrated circuit chip U3 is connected to the seventh pin of the main control chip U1; the seventh pin of the radio frequency integrated circuit chip U3 is grounded via the capacitor C8; the eighth pin of the radio frequency integrated circuit chip U3 is grounded via the crystal oscillator JZ2. Accordingly, after the antenna AT receives an external RF control remote signal, the signal is amplified via the chip inductors L1, L2 and the capacitors C4, C5, C6, following which it is inputted into the radio frequency integrated circuit chip U3. After the signal is converted into an operational command by the radio frequency integrated circuit chip U3, it is transmitted to the main control chip U1 to perform the subsequent control and adjustment actions.

The control output circuit 16 includes a control chip U4, a resistor R4 and an indicator lamp circuit 161 connected to the control chip U4. The control chip U4 is an erasable programable read only memory (EPROM) with 16 pins, and its fifth pin is connected to the output end (third pin) of the three-terminal voltage regulator Q7 in order to conduct the required power source. The sixth pin, seventh pin, eighth pin and ninth pin of the control chip U4 are respectively connected to the first pin, fourteenth pin, thirteenth pin and twelfth pin of the main control chip U1 in order to receive the control signal outputted by the main control chip U1. The tenth pin of the control chip U4 is connected to the eighth pin of the main control chip U1 via the resistor R4, and the twelfth pin of the control chip U4 is grounded. The thirteenth pin, the fourteenth pin, fifteenth pin and sixteenth pin of the control chip U4 are jointly connected to a main control signal output end Scon in order to provide a main control signal necessary for the subsequent actions of the branch controller 2.

The indicator lamp circuit 161 comprises: two indicator lamps D1, D2 (can be LEDs) connected in a forward-reverse parallel manner and having one end connected to the first pin of the control chip U4 respectively, two indicator lamps D3, D4 (can be LEDs) connected in a forward-reverse parallel manner and having one end connected to the second pin of the control chip U4 respectively. Other ends of the indicator lamps D1, D2, D3 and D4 are jointly connected to the third pin of the control chip U4 via the resistor R2, thereby allowing the timing circuit 13 to set various timing periods for the indicator lamps D1, D2, D3 and D4 via the first pin, second pin, third pin of the control chip U4 and the resistor R2.

The branch controller 2 comprises: a signal transmission circuit 21 and a driving circuit 22; wherein the signal transmission circuit 21 includes a plurality of signal transmission chips U5, U6, U7, U8 connected in series, resistors R5~R22 and capacitors C10~C13.

The first pin, second pin and the third pin of the signal transmission chip U8 are directly connected to a branch power source input end V+ via the resistors R18, R19, R20 respectively in sequence, and the fourth pin of the signal transmission chip U8 is directly connected to a ground end GND. The fifth pin of the signal transmission chip U8 is connected to the sixth pin of the signal transmission chip U7 via the resistor R16. The sixth pin of the signal transmission chip U8 is connected to a branch control signal input end Sin via the resistor R21, and the branch control signal input end Sin is connected to the main control signal output end Scon of the main controller 1 in order to receive the main control signal outputted from the main controller 1. The eighth pin of the signal transmission chip U8 is connected to the branch power source input end V+ via the resistor R22, and the branch power source input end V+ is connected to the main power source output end VDCout (branch power supply end) of the main controller 1 in order to receive the power supplied from the main controller 1. In addition, the capacitor C13 is arranged between the first pin and the eighth pin of the signal transmission chip U8.

The first pin, second pin and the third pin of the signal transmission chip U7 are respectively connected to the branch power source input end V+ in sequence via the resistors R13, R14, R15. The fourth pin of the signal transmission chip U7 is directly connected to the ground end GND. The fifth pin of the signal transmission chip U7 is connected to the sixth pin of the signal transmission chip U6 via the resistor R12. The eighth pin of the signal transmission chip U7 is connected to the branch power source input end V+ via the resistor R17 in order to conduct the required power source. In addition, the capacitor C12 is arranged between the first pin and the eighth pin of the signal transmission chip U7.

The first pin, second pin and third pin of the signal transmission chip U6 are respectively connected to the branch power source input end V+ in sequence via the resistors R9, R10, R11 in order to conduct the required power source. The fourth pin of the signal transmission chip U6 is directly connected to the ground end GND. The fifth pin of the signal transmission chip U6 is connected to the sixth pin of the signal transmission chip U5 via the resistor R8. The capacitor C11 is arranged between the first pin and the eighth pin of the signal transmission chip U6.

The first pin, second pin and third pin of the signal transmission chip U5 are respectively connected to the branch power source input end V+ in sequence via the resistors R5, R6, R7 in order to conduct the required power source. The fourth pin of the signal transmission chip U6 is directly connected to the ground end GND. The fifth pin of the signal transmission chip U6 is connected to a branch control signal output end Sout. The branch control signal output end Sout is configured to be connected to another branch controller 2 and to provide a control signal required. The capacitor C10 is arranged between the first pin and the eighth pin of the signal transmission chip U5.

The driving circuit 22 includes: driving chips U9~U13, resistors R23~R27 and a connecting terminal PIN. The first pins of the driving chips U9, U10, U11, U12, U13 are connected to the branch power source input end V+ respectively in order to conduct the power source required. The third pin and seventh pin of the driving chips U9, U10, U11, U12, U13 are connected to the ground end GND respectively.

The second pin and fourth pin of the driving chip U13 are connected to the first pin and second pin of the connecting terminal PIN via the resistor R27 in order to form a first terminal set provided for connecting to an external decorative light modules 3 (LED light string/light strip). The fifth pin and eighth pin of the driving chip U13 are connected to the first pin and the second pin of the signal transmission chip U8 in order to receive signals from the signal transmission chip U8 and to control the decorative light module 3 connected to the first terminal set (first pin and second pin) of the connecting terminal PIN.

The second pin and fourth pin of the driving chip U12 are connected to a third pin and a fourth pin of the connecting terminal PIN via the resistor R26 in order to form a second terminal set provided for connecting to an external decorative light modules 3 (LED light string/light strip). The fifth pin of the driving chip U12 is connected to the third pin of the signal transmission chip U8. The eighth pin of the driving chip U12 is connected to the first pin of the signal transmission chip U7, thereby receiving signals from the signal transmission chips U7, U8 respectively in order to drive the decorative light module 3 connected to the second terminal set (third pin and fourth pin) of the connecting terminal PIN.

The second pin and fourth pin of the driving chip U11 are connected to the fifth pin and sixth pin of the connecting terminal PIN via the resistor R25 in order to form a third terminal set provided for connecting to an external decorative light modules 3 (LED light string/light strip). The fifth pin and eighth pin of the driving chip U11 are respectively connected to the second pin and third pin of the signal transmission chip U7 in sequence, thereby receiving signals from the signal transmission chip U7 in order to control the decorative light module 3 connected to the third terminal set (fifth pin and sixth pin) of the connecting terminal PIN.

The second pin and fourth pin of the driving chip U10 are connected to the seventh pin and eighth pin of the connecting terminal PIN via the resistor R24 in order to form a fourth terminal set provided for connecting to an external decorative light module 3 (LED light string/light strip). The fifth pin and eighth pin of the driving chip U10 are respectively connected to the second pin and third pin of the signal transmission chip U6 in sequence, thereby receiving signals from the signal transmission chip U6 in order to control the decorative light module 3 connected to the fourth terminal set (seventh pin and eighth pin) connected to the connecting terminal PIN.

The second pin and fourth pin of the driving chip U9 are connected to the ninth pin and tenth pin of the connecting terminal PIN via the resistor R23 in order to form a fifth terminal set provided for connecting to an external decorative light modules 3 (LED light string/light strip). The fifth pin and eighth pin of the driving chip U9 are respectively connected to the first pin and second pin of the signal transmission chip U5 in sequence, thereby receiving signals from the signal transmission chip U5 in order to drive the decorative light module 3 connected to the fifth terminal set (ninth pin and tenth pin) of the connecting terminal PIN.

Through the aforementioned connection method of connecting each one of the signal transmission chips U5, U6, U7, U8 with each other, the main control signal inputted by the branch control signal input end Sin can be inputted from the fifth pin of the signal transmission chip U8, followed by respectively transmitting to the signal transmission chips U7, U6, U5 in sequence. Then, the driving circuit 22 is able to drive each set of the decorative light modules 3 connected to the connecting terminal PIN respectively.

Figure 4:
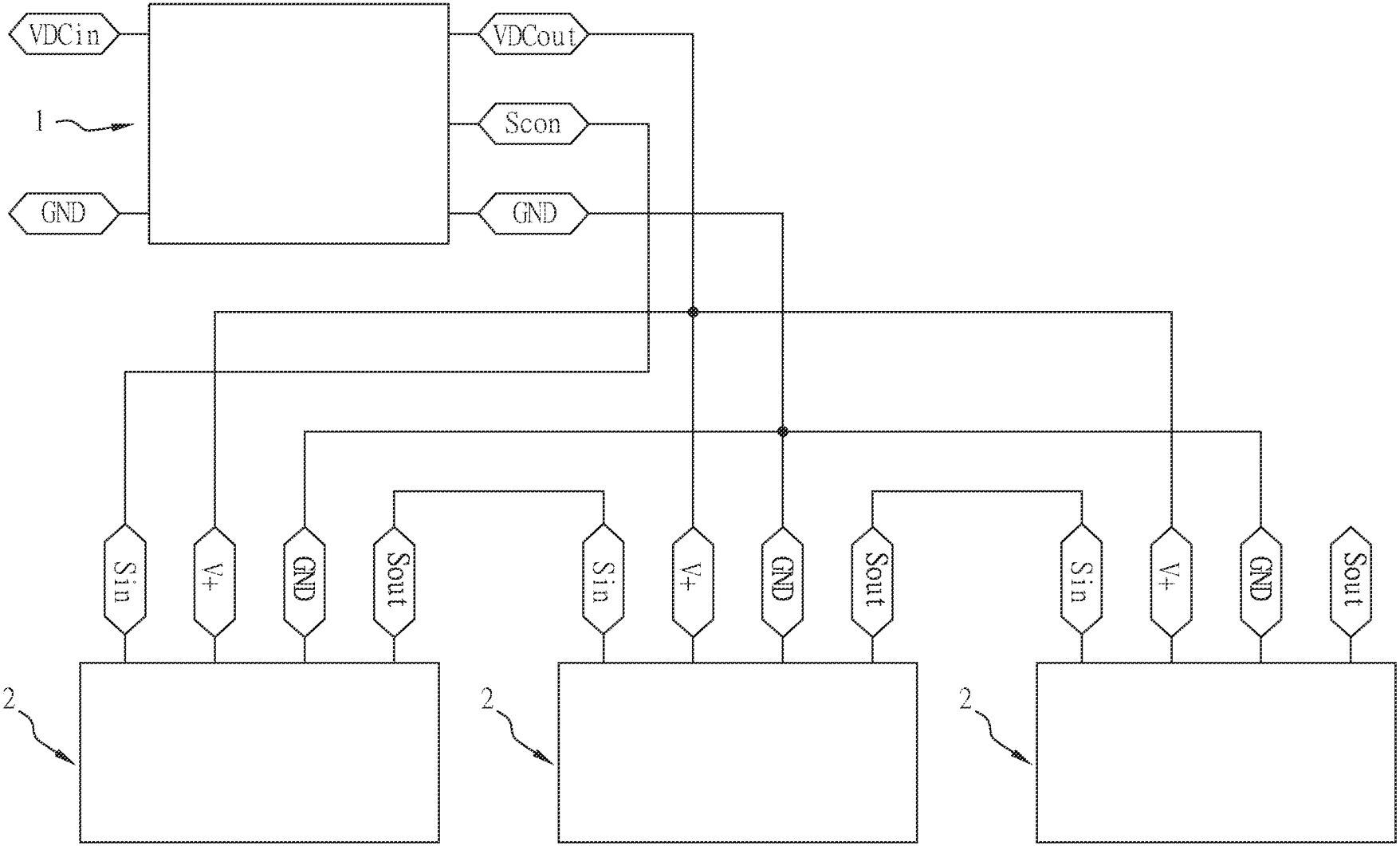
FIG. 4 is a circuit diagram illustrating the main controller connected to a plurality of branch controllers with each other of the present invention.

As shown in FIG. 4, it can be understood that during the actual application of the aforementioned structure of the present invention, a plurality of branch controllers 2 of an appropriate quantity can be installed according to the energy supplied by the power supply and the demanded quantity of the decorative light modules 3 (LED light strings/light strips) desired to be installed on each tree branch of the Christmas tree, such that each of the decorative light modules 3 is connected to each one of the branch controller 2 respectively, following which a main controller 1 is used for connecting to the plurality of branch controllers 2 in series in order to control such branch controllers. The configuration method is as follows:

The main power source output end VDCout (branch power supply end) of the main controller 1 is connected to the branch power source input end V+ of each one of the branch controller 2 respectively, and the ground end GND of the main controller 1 is connected to the ground end GND of each one of the branch controllers 2 respectively, in order to provide the power source necessary for each one of the branch controllers 2. The main control signal output end Scon of the main controller 1 is connected to the branch control signal input tend Sin of one of the branch controllers 2 (referred to as the first branch controller 2), in order to transmit a main control signal outputted by the main controller 1 to the (first) branch controller 2. At the same time, the branch control signal output end Sout of the (first) branch controller 2 is connected to the branch control signal input end Sin of another branch controller 2 (referred to as the second branch controller 2). Consequently, through such connection method of connecting the branch control signal output end Sout of different branch controller 2 to another branch control signal input end Sin, a decorative light structure having one single main controller 1 connected to and controlling a plurality of light decorative modules 3 (LED light strings/light strips) via a plurality of branch controllers 2 can be assembled and achieved.

In the aforementioned structure of the present invention, each branch controller 2 can use the connecting terminal PIN for connecting to a plurality of decorative light modules 3 (LED light strings/light strips) installed on each tree branch, and the quantity of the branch controllers 2 and the quantities of the signal transmission circuits 21 and driving circuits 22 in each branch controller 2 can be expanded depending upon the actual condition. The control output circuit 16 of the main controller 1 sends out the main control signal via the main control signal output end Scon, and the signal transmission circuit 21 of a branch controller 2 then receives the main control signal via the branch control signal input end Sin, and the signal is further transmitted to the driving circuit 22. The driving circuit 22 then uses different driving chips U9~U13 to jointly control the actions of the light decorative modules 3 via the connecting terminal PIN. Accordingly, with such structure, each one of the decorative light modules 3 on each one of the tree branches of the Christmas tree can be prevented from interfering with each other, and during any malfunction, inspection and repair can be performed easily. Furthermore, the light decorative modules 3 on different tree branches can also have their own independent wiring during the installation, followed by integrating the circuits together onto the connecting terminal PIN of the branch controller 2. Finally, all of the branch controllers 2 are connected to a main controller 1 in order to allow the main controller 1 to perform uniform control, and the overall circuits are neatly arranged.

What is claimed is:

1. An illuminated Christmas tree decorative light control circuit, comprising:

a main controller and at least one branch controller electrically connected to the main controller; wherein the main controller comprises a main control circuit and a control output circuit, the main control circuit having a main control chip arranged therein, the main control chip being an erasable programmable read only memory (EPROM) with a plurality of pins and being equipped with a built-in dimming function in order to control and generate a control signal for a plurality of lighting modes, the control output circuit being configured to receive the control signal outputted by the main control circuit and convert the control signal to output a main control signal; and each one of the at least one branch controller comprises a signal transmission circuit, a driving circuit and a connecting terminal, the signal transmission circuit being configured to receive the main control signal outputted by the control output circuit, and being connected to the connecting terminal via the driving circuit and being divided into a plurality of terminal sets, thereby using each terminal set for connecting to a decorative light module installed on each branch of a Christmas tree, such that each decorative light module is able to receive an operation control of the main controller via each one of the at least one branch controller.

2. The illuminated Christmas tree decorative light control circuit according to claim 1, wherein the main controller further comprises:

a timing circuit, a memory circuit and a radio frequency (RF) remote control circuit connected to the main control circuit respectively, the RF remote control circuit being configured to receive a RF wireless control signal from external in order to form an operational command inputted into the main control circuit, the timing circuit being configured to be operable for adjusting a running time of the main control circuit, the memory circuit being configured to store a control parameter for the main control chip.

3. The illuminated Christmas tree decorative light control circuit according to claim 2, wherein the main controller further comprises:

an anti-reverse power source connection circuit connected to the main control circuit; the anti-reverse power source connection circuit comprising one three-terminal voltage regulator and a diode; the diode being arranged between an input end of the three-terminal voltage regulator and a main power source input end in a forward direction, such that when a polarity of an external power source connected to the main power source input end is correct, the diode is conducted in order to allow the three-terminal voltage regulator to operate normally; and when the polarity is incorrect, the diode is not conducted to prevent the power source from connecting to the three-terminal voltage regulator.

4. The illuminated Christmas tree decorative light control circuit according to claim 3, further comprising first to fourth resistors, wherein the control output circuit comprises another control chip, the fourth resistor and an indicator lamp circuit; the another control chip is an erasable programable read only memory with 16 pins, a fifth pin of the another control chip is connected to the output end of the three-terminal voltage regulator in order to provide a power source necessary for conduction; a sixth pin, a seventh pin, an eighth pin and a ninth pin of the another control chip connected to a first pin, a fourteenth pin, a thirteenth pin and a twelfth pin of the main control chip respectively in order to receive the control signal outputted by the main control chip; a tenth pin of the another control chip is connected to an eighth pin of the main control chip via the fourth resistor, a twelfth pin of the another control chip is connected to a ground end; a thirteenth pin, a fourteenth pin, a fifteenth pin and a sixteenth pin of the another control chip are jointly connected to a main control signal output end in order to output the main control signal for controlling the at least one branch controller; the indicator lamp circuit comprises four indicator lamps, wherein two of the indicator lamps are connected to each other in a forward-reverse parallel manner, and one end thereof is connected to a first pin of the another control chip, the other two indicator lamps are connected to each other in a forward-reverse parallel manner, and one end thereof is connected to a second pin of the another control chip, another end of the four indicator lamps is connected to a third pin of the another control chip jointly via the second resistor, such that the timing circuit is able to set various timing periods for the indicator lamps via the first pin, the second pin and third pin of the another control chip and the second resistor.

5. The illuminated Christmas tree decorative light control circuit according to claim 4, wherein the main control chip has 14 pins; a tenth pin of the main control chip is connected to an output end of the three-terminal voltage regulator via the third resistor, and the tenth pin of the main control chip is further connected to the ground end via a switch.

6. The illuminated Christmas tree decorative light control circuit according to claim 5, wherein the timing circuit includes a first capacitor, a second capacitor and a first crystal oscillator, two ends of the first crystal oscillator are connected to a fifth pin and a sixth pin of the main control chip respectively, and the two ends of the first crystal oscillator are further connected to the ground end via the first and second capacitors.

7. The illuminated Christmas tree decorative light control circuit according to claim 5, wherein the memory circuit comprises a storage chip with 8 pins and the first resistor, an eighth pin of the storage chip is connected to the output end of the three-terminal voltage regulator, and the eighth pin of the storage chip is further connected to a third pin of the main control chip and a fifth pin of the storage chip respectively via the first resistor, a sixth pin of the storage chip is connected to a second pin of the main control chip, and a fourth pin of the storage chip is connected to the ground end.

8. The illuminated Christmas tree decorative light control circuit according to claim 5, wherein the RF remote control circuit comprises a radio frequency integrated circuit chip with 8 pins, a first chip inductor, a second chip inductor, fourth to eighth capacitors, a second crystal oscillator and an antenna;

a first pin and a sixth pin of the radio frequency integrated circuit chip are jointly connected to the ground end;

a second pin and a third pin of the radio frequency integrated circuit chip are jointly connected to the output end of the three-terminal voltage regulator and also jointly connected to one end of the the fourth capacitor and the sixth capacitor and to one end of the first chip inductor, another end of the fourth capacitor is respectively connected to one end of the fifth capacitor, one end of the second chip inductor and the antenna, another end of the sixth capacitor, another end of the first chip inductor, another end of the second chip inductor and another end of the fifth capacitor are jointly connected to the ground end respectively, a fourth pin of the radio frequency integrated circuit chip is grounded via the seventh capacitor, a fifth pin of the radio frequency integrated chip is connected to a seventh pin of the main control chip, a seventh pin of the radio frequency integrated circuit chip is grounded via the eighth capacitor, and an eighth pin of the radio frequency integrated circuit chip is connected to the ground end via the second crystal oscillator.

9. The illuminated Christmas tree decorative light control circuit according to claim 3, wherein the main power source input end is connected to an external AC power source via a power source module, such that the AC power source is converted to a DC power source of DC5V-36V via the power source module, and further connected to the main power source input end.

10. The illuminated Christmas tree decorative light control circuit according to claim 1, wherein the signal transmission circuit comprises:

first to fourth signal transmission chips connected in series, fifth to twenty-second resistors, and tenth to thirteenth capacitors; wherein each one of the first to fourth signal transmission chips is a single-wire transmission three-channel LED driver control chip with 8 pins;

a first pin, a second pin and a third pin of the fourth signal transmission chip are respectively connected to a branch power source input end in sequence via the eighteenth to twentieth resistors;

a fourth pin of the fourth signal transmission chip is directly connected to the ground end, a fifth pin of the fourth signal transmission chip is connected to a sixth pin of the third signal transmission chip via the sixteenth resistor;

the sixth pin of the fourth signal transmission chip is connected to a branch control signal input end via the twenty-first resistor;

the branch control signal input end is configured to receive the main control signal outputted by the main controller;

an eighth pin of the fourth signal transmission chip is connected to the branch power source input end via the twenty-second resistor;

the branch power source input end is configured to receive a power source provided by the main controller, and the thirteenth capacitor is arranged between the first pin and the eighth pin of the fourth signal transmission chip;

a first pin, a second pin and a third pin of the third signal transmission chip are respectively connected to the branch power source input end in sequence via the thirteenth to fifteenth resistors;

a fourth pin of the third signal transmission chip is directly connected to the ground end;

a fifth pin of the third signal transmission chip is connected to a sixth pin of the second signal transmission chip via the twelfth resistor;

an eighth pin of the third signal transmission chip is connected to the branch power source input end via the seventeenth resistor in order to conduct to a power source required, and the twelfth capacitor is arranged between the first pin and the eighth pin of the third signal transmission chip;

a first pin, a second pin and a third pin of the second signal transmission chip are respectively connected to the branch power source input end in sequence via the ninth to eleventh resistors in order to conduct to a power source required;

a fourth pin of the second signal transmission chip is directly connected to the ground end;

a fifth pin of the second signal transmission chip is connected to a sixth pin of the first signal transmission chip via the eighth resistor, and the eleventh capacitor is arranged between the first pin and the eighth pin of the second signal transmission chip;

a first pin, a second pin and a third pin of the first signal transmission chip are respectively connected to the branch power source input end in sequence via the fifth to seventh resistors in order to conduct to a power source required;

a fourth pin of the first signal transmission chip is directly connected to the ground end;

the fifth pin of the first signal transmission chip is connected to a branch control signal output end;

the branch control signal output end is configured to be connected to another branch controller and to provide a control signal required; and the tenth capacitor is arranged between the first pin and the eighth pin of the first signal transmission chip.

11. The illuminated Christmas tree decorative light control circuit according to claim 10, wherein the driving circuit comprises:

first to fifth driving chips, and

23th to 27th resistors; wherein each one of the first to fifth driving chips is a two-way driving control chip with 8 pins;

the first pins of the first to fifth driving chips are respectively connected to a branch power source input end in order to conduct to a power source required;

the third pins and seventh pins of the first to fifth driving chips are respectively connected to a ground end;

a second pin and a fourth pin of the fifth driving chip are connected to a first pin and a second pin of the connecting terminal via the 27th resistor in order to form a first terminal set provided for connecting to each one of the decorative light modules;

a fifth pin and an eighth pin of the fifth driving chip are respectively connected to a first pin and a second pin of the fourth signal transmission chip, thereby receiving signals from the fourth signal transmission chip to drive the decorative light module connected to the first terminal set of the connecting terminal;

a second pin and a fourth pin of the fourth driving chip are connected to a third pin and a fourth pin of the connecting terminal via the 26th resistor in order to form a second terminal set provided for connecting to each one of the decorative light modules;

a fifth pin of the fourth driving chip is connected to a third pin of the fourth signal transmission chip, an eighth pin of the fourth driving chip is connected to a first pin of the third signal transmission chip, thereby receiving signals from the third and fourth signal transmission chips respectively in order to drive the decorative light module connected to the second terminal set of the connecting terminal;

a second pin and a fourth pin of the third driving chip are connected to a fifth pin and a sixth pin of the connecting terminal via the 25th resistor in order to form a third terminal set provided for connecting to each one of the decorative light modules;

a fifth pin and an eighth pin of the third driving chip are respectively connected to a second pin and a third pin of the third signal transmission chip, thereby receiving signals from the third signal transmission chip in order to drive the decorative light module connected to the third terminal set of the connecting terminal;

a second pin and a fourth pin of the second driving chip are connected to a seventh pin and an eighth pin of the connecting terminal via the 24th resistor in order to form a fourth terminal set provided for connecting to each one of the decorative light module;

a fifth pin and an eighth pin of the second driving chip are respectively connected to a second pin and a third pin of the second signal transmission chip, thereby receiving signals from the second signal transmission chip in order to drive the decorative light module connected to the fourth terminal set connected to the connecting terminal;

a second pin and a fourth pin of the first driving chip are connected to a ninth pin and a tenth pin of the connecting terminal via the 23th resistor in order to form a fifth terminal set provided for connecting to each one of the decorative light modules; and a fifth pin and an eighth pin of the first driving chip are respectively connected to a first pin and a second pin of the first signal transmission chip, thereby receiving signals from the first signal transmission chip in order to drive the decorative light module connected to the fifth terminal set of the connecting terminal.

* * * * *